US006340949B1

(12) United States Patent
Lane et al.

(10) Patent No.: US 6,340,949 B1
(45) Date of Patent: Jan. 22, 2002

(54) MULTIPLE BEAM PHASED ARRAY WITH APERTURE PARTITIONING

(75) Inventors: Steven O. Lane, Rolling Hills Estates; James C. McCleary, Irvine, both of CA (US)

(73) Assignee: Hughes Electronics Corporation, El Segundo, CA (US)

( * ) Notice: Subject to any disclaimer, the term of this patent is extended or adjusted under 35 U.S.C. 154(b) by 0 days.

(21) Appl. No.: 09/732,836

(22) Filed: Dec. 7, 2000

(51) Int. Cl.[7] ..... H01Q 3/26
(52) U.S. Cl. ..... 342/373; 342/372; 342/354
(58) Field of Search ..... 342/81, 154, 354, 342/372, 373; 455/12.1, 13.1

(56) References Cited

U.S. PATENT DOCUMENTS 6,011,512 A * 1/2000 Cohen ..... 342/372
6,064,859 A * 5/2000 Leopold et al. ..... 455/13.1
6,088,572 A * 7/2000 Vatt et al. ..... 455/13.1

* cited by examiner

*Primary Examiner*—Dao Phan
(74) *Attorney, Agent, or Firm*—V. D. Duraiswamy; M. W. Sales

(57) ABSTRACT

A multiple beam phased array includes a plurality of array elements partitioned into a plurality of array element groups for forming a plurality of beams wherein each array element group has a taper center located to minimize maximum array element power for the plurality of beams.

8 Claims, 8 Drawing Sheets

MULTIPLE BEAM PHASED ARRAY WITH APERTURE PARTITIONING

BACKGROUND OF THE INVENTION

The present invention relates generally to active phased array antenna arrays for generating communications signals on multiple beams. More specifically, but without limitation thereto, the present invention relates to partitioning an active phased array antenna to reduce the peak signal power requirement of the solid state power amplifiers of each array element.

A typical active phased array antenna consists of many array elements arranged in a circular, square, or elliptical aperture. For a transmitting array, the distribution of signal amplitudes that drive the array elements may be tapered, with higher amplitude signals driving array elements near the center of the array to minimize sidelobes of the antenna pattern. The center array elements of the phased array antenna are generally the center elements for all beams. If different signals are transmitted on each beam, then the peak signal power output of the center array elements is approximately the sum of the peak signal power of all beams. If a large number of beams are used, then the maximum output power and average output power requirements of the array element power amplifiers may increase the cost of the array element power amplifiers. Also, because the center array elements are used to generate each beam, the number of phase shifters required at each of the center array elements is equal to the number of beams, and the complexity of the power combiner required to combine the output of the phase shifters at each array element is correspondingly high.

SUMMARY OF THE INVENTION

The present invention advantageously addresses the problems above as well as other problems by providing a multiple beam phased array with aperture partitioning that minimizes the required maximum output signal power of the array element power amplifiers.

In one embodiment, the present invention may be characterized as a multiple beam phased array that includes a plurality of array elements partitioned into a plurality of array element groups for forming a plurality of beams wherein each array element group has a taper center located to minimize maximum array element power for the plurality of beams.

In another embodiment, the present invention may be characterized as a method of partitioning array elements of a multiple beam phased array that includes the steps of defining a group of array elements for each of a plurality of beams and locating a taper center of each group of array elements in the multiple beam phased array to minimize maximum array element power.

BRIEF DESCRIPTION OF THE DRAWINGS

The above and other aspects, features and advantages of the present invention will be more apparent from the following more specific description thereof, presented in conjunction with the following drawings wherein.

Corresponding reference characters indicate corresponding elements throughout the several views of the drawings.

DETAILED DESCRIPTION OF THE DRAWINGS

The following description is presented to disclose the currently known best mode for making and using the present invention. The scope of the invention is defined by the claims.

Figure 1:
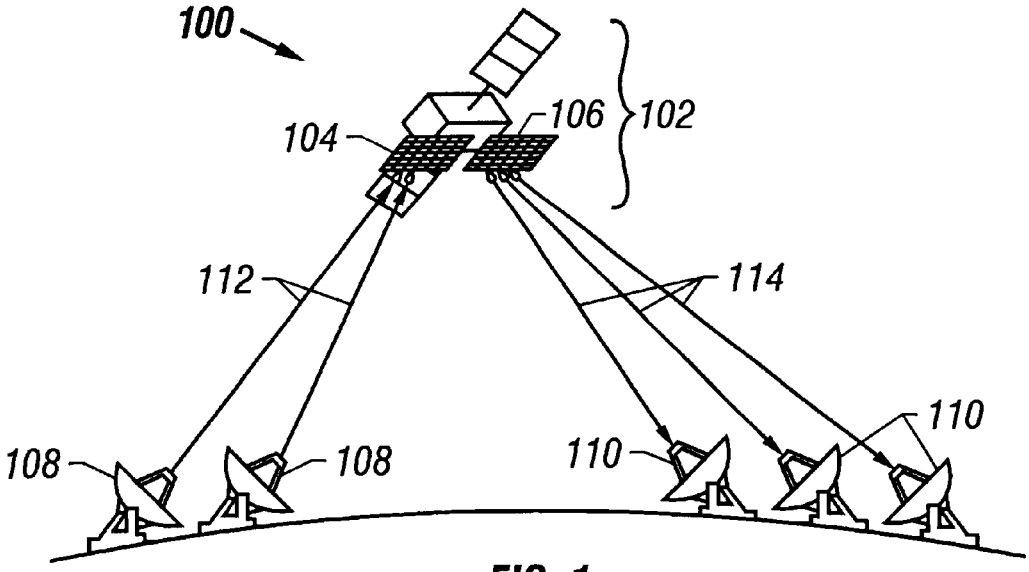
FIG. 1 is a diagram of a transponder platform communications system;.

FIG. 1 is a diagram of a transponder platform communications system 100. In this example, the transponder platform is illustrated as a satellite transponder platform, however, other spaceborne, airborne, and terrestrial transponder platforms may also be used in other embodiments to suit specific applications. Shown in FIG. 1 are a transponder platform 102, a multi-beam receiving antenna 104, a multi-beam phased array transmitting antenna 106, ground transmitters 108, ground receivers 110, received beam signals 112, and transmitted beam signals 114.

In operation, the ground transmitters 108 transmit communications signals to the transponder platform 102 that are received by the multi-beam receiving antenna 104 as received beam signals 112. The communications signals are then re-transmitted from the multi-beam phased array transmitting antenna 106 as the transmitted beam signals 114 to the ground receivers 110.

Figure 2:
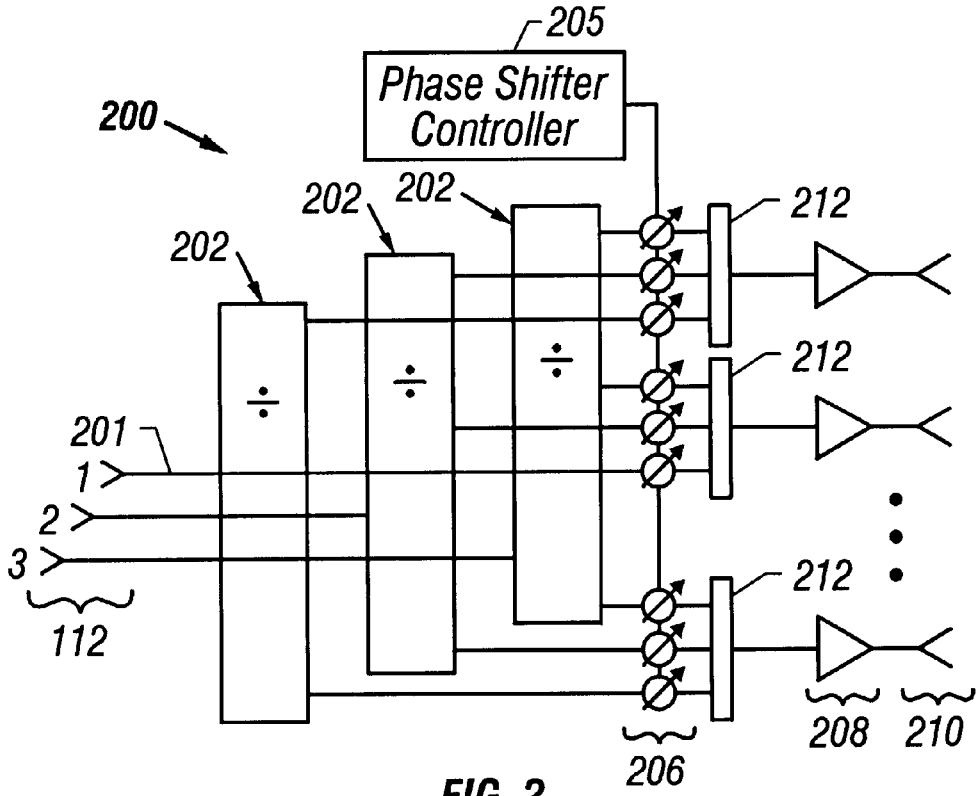
FIG. 2 (Prior Art)
FIG. 2 is a diagram of a conventional phase control network for the multiple beam phased array transmitting antenna of FIG. 1.

FIG. 2 is a diagram of a phase control network 200 for the multi-beam phased array transmitting antenna 106 of FIG. 1. Shown in FIG. 2 are beam input ports 201, power dividers 202, a phase shifter controller 205, phase shifters 206, array element power amplifiers 208, array elements 210, and power combiners 212.

Each of the received signals 112 from the multi-beam receiving antenna 104 is coupled to one of the corresponding beam input ports 201. The beam input ports 201 are coupled respectively to the power dividers 202. The power dividers 202 are coupled respectively to phase shifters 206. The outputs of the phase shifters 206 are connected to the power combiners 212. The phase shifter controller 205 sets the amount of phase shift for each phase shift controller to generate each selected beam. The outputs of the power combiners are connected respectively to the array element power amplifiers 208. The array element power amplifiers 208 may be, for example, solid state power amplifiers (SSPAs). The outputs of the array element power amplifiers 208 are connected respectively to the array elements 210. The array elements 210 may be, for example, a circular array of uniformly spaced patch antenna elements.

In operation, the power dividers 202 split each of the input signals 112 at the beam input ports 201. The phase coefficients that determine the beam pointing direction are implemented in this example by the phase shifters 206. The phase shifters 206 are controlled by the phase shifter controller 205. Phase-shifted signals output from the phase shifters 206 for each beam are summed by the power combiners 212 and amplified by the array element power amplifiers 208. The outputs of the array element power amplifiers 208 are connected to the array elements 210, which radiate the transmitted beam signals 114 to the ground receivers 110.

Figure 3:
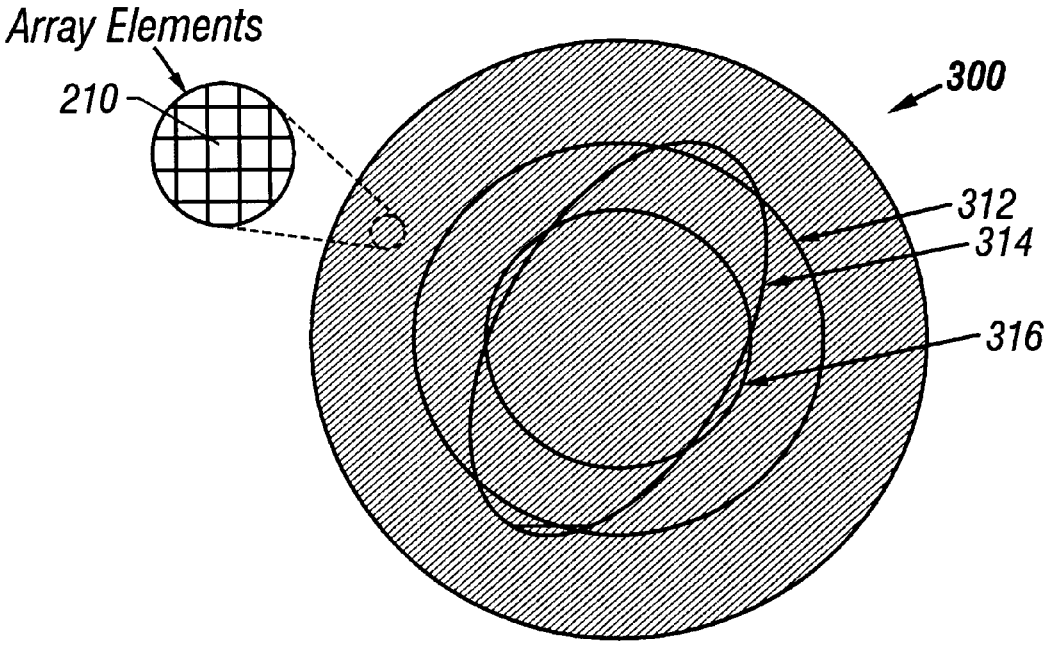
FIG. 3 (Prior Art)
FIG. 3 is a diagram of a circular array for the multi-beam phased array transmitting antenna of FIG. 1 illustrating a conventional array element grouping method.

FIG. 3 is a diagram of a single circular array aperture 300 for the multi-beam phased array transmitting antenna 106 of FIG. 1 illustrating conventional array element grouping for transmitting three beams. Shown in FIG. 3 are an array element group 312 for transmitting a beam A, an array element group 314 for transmitting a beam B, and an array element group 316 for transmitting a beam C. While only three beams are shown to simplify the illustration, there are generally many more beams used in a typical communications system. The array elements 210 are shown as the dense grid of squares in the circular array 300, where each square represents one of the array elements 110. Other arrangements of array elements may be used to suit specific applications.

A typical assignment or partitioning of the array elements 210 used for the beams A, B, and C is shown by the array elements 210 included within the conventional arrangement of array element groups 312, 314, and 316, respectively. Each of the array element groups 312, 314, and 316 share a common center, so that the array elements 210 in the center of the array are used by all three beams A, B, and C, while the array elements 210 at the edge of the array are scarcely used at all. The peak signal power of the array elements 210 in the center of the array is therefore the sum of the peak signal power of all the beams. Also, the number of phase shifters required for the array elements 210 in the center of the array is equal to the total number of beams.

Figure 4:
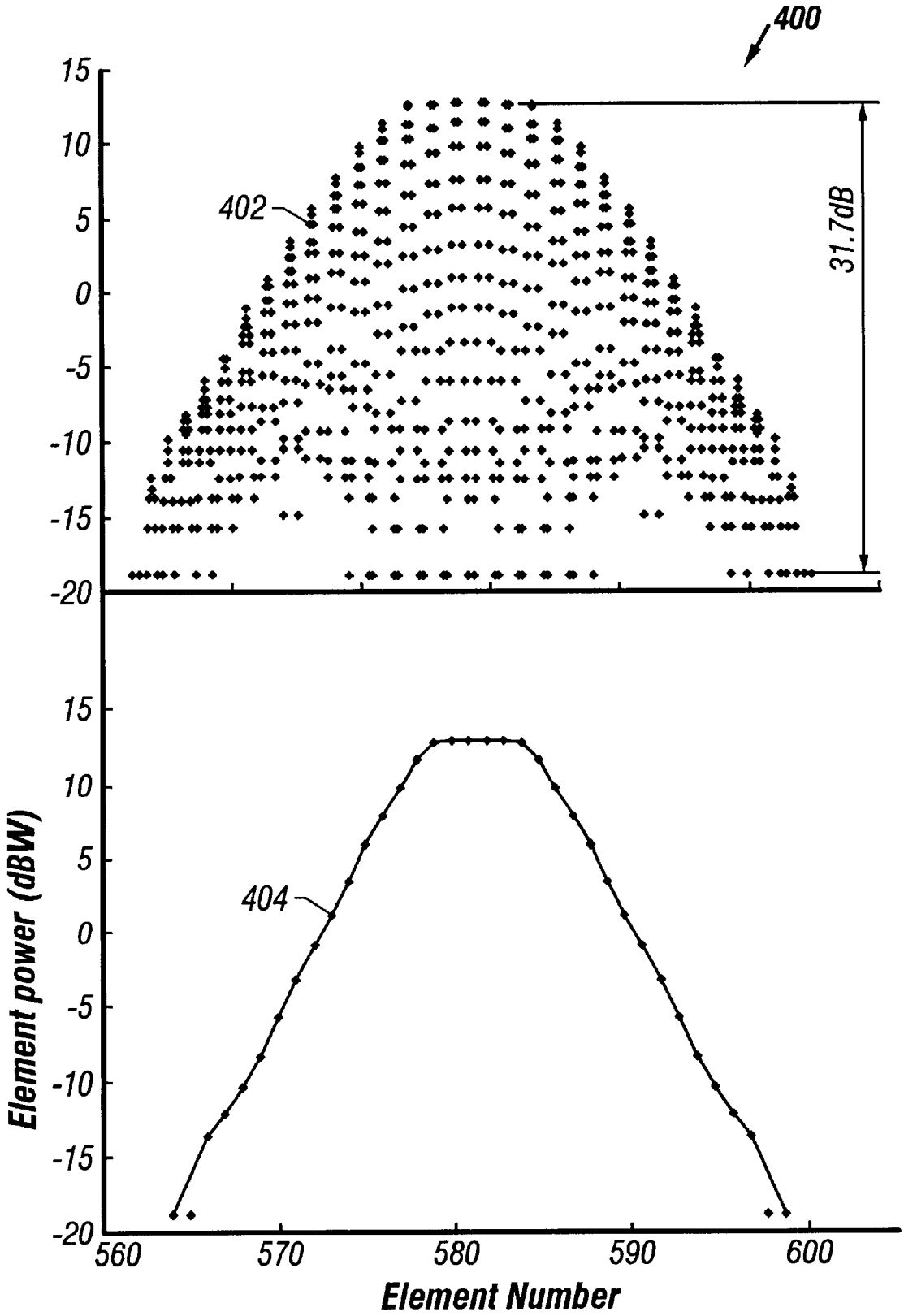
FIG. 4 (Prior Art)
FIG. 4 is an exemplary plot of peak signal power vs. array element number for the array element grouping method of FIG. 3.

FIG. 4 is an exemplary plot 400 of peak signal power vs. array element number for the conventional array element grouping method of FIG. 3 for 600 array elements and 169 beams. The upper curve 402 shows the peak power for each element, and the lower curve 404 shows the envelope of the peak power for all elements. The maximum peak signal power for the center array elements is about 12 dBW, and the corresponding dynamic range required of the array element power amplifiers 208 is 31.7 dB. The array elements 210 at the center of the array require 169 phase shifters 206, while those at the edge of the array only require one phase shifter 206.

Figure 5:
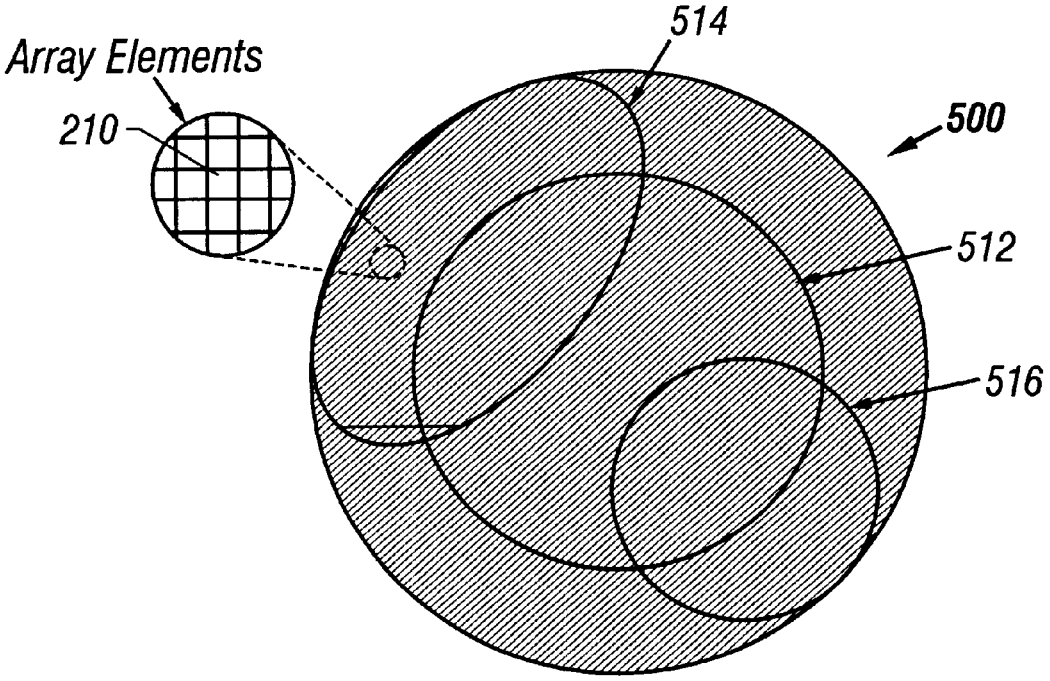
FIG. 5 is a diagram of a circular array for the multi-beam phased array transmitting antenna of FIG. 1 illustrating an aperture partitioning method according to an embodiment of the present invention.

FIG. 5 is a diagram of a circular array 500 for the multi-beam phased array transmitting antenna 106 of FIG. 1 illustrating aperture partitioning. Shown in FIG. 5 are an array element group 512 for transmitting a beam A, an array element group 514 for transmitting a beam B, and an array element group 516 for transmitting a beam C. In contrast to the conventional array element grouping arrangement illustrated in FIG. 3, array element groups 512, 514 and 516 are arranged to minimize the peak signal power of each of the array elements 210. As a result, the peak signal power from any one of the array elements 210 is the sum of the peak signal power of fewer than all the beams. Also, the number of phase shifters required for the array elements 210 in the center of the array is fewer than the number of beams. A beam uses an array element 210 if the array element 210 lies within the contour defining the array element group. Each array element 210 requires a separate phase shifter 206 and a power combiner input for each beam that uses that array element. The number of phase shifters $N_k$ required for the kth array element 210 may be expressed as $$N_k = \sum_{i=1}^{N_{beams}} \begin{cases} 1, & \text{if beam } i \text{ uses element } k \\ 0, & \text{otherwise} \end{cases} \tag{1}$$

The total number of phase shifters required is then given by $$N_{TOTAL} = \sum_{k=1}^{N_{ELEMENTS}} N_k \tag{2}$$

Figure 6:
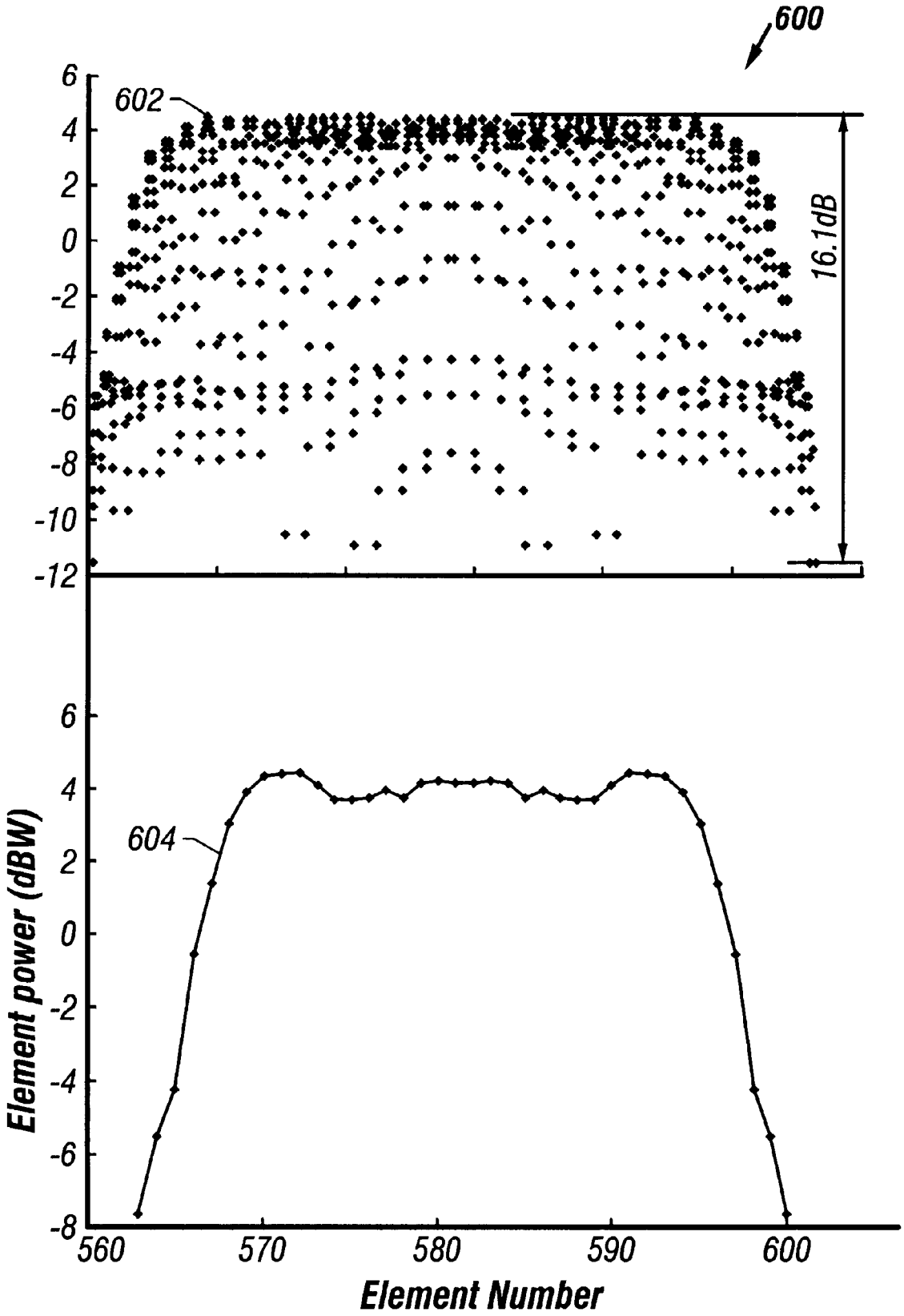
FIG. 6 is an exemplary plot of peak signal power vs. array element number for the aperture partitioning method of FIG. 5.

FIG. 6 is an exemplary plot 600 of peak signal power vs. array element number for the aperture partitioning method of FIG. 5 with 600 array elements and 169 beams. The upper curve 602 shows the peak power for each element, and the lower curve 604 shows the envelope of the peak power for all elements. The maximum peak signal power for any one of the array elements 210 is only about 4.0 dBW, and the corresponding dynamic range required of the array element power amplifiers 208 is only 16.1 dB. While the total number of phase shifters 206 required remains the same, the maximum number of phase shifters 206 required by any single array element 210 is only 67. Also, the maximum number of inputs required by the power combiner 212 is reduced by 60 percent.

Figure 7:
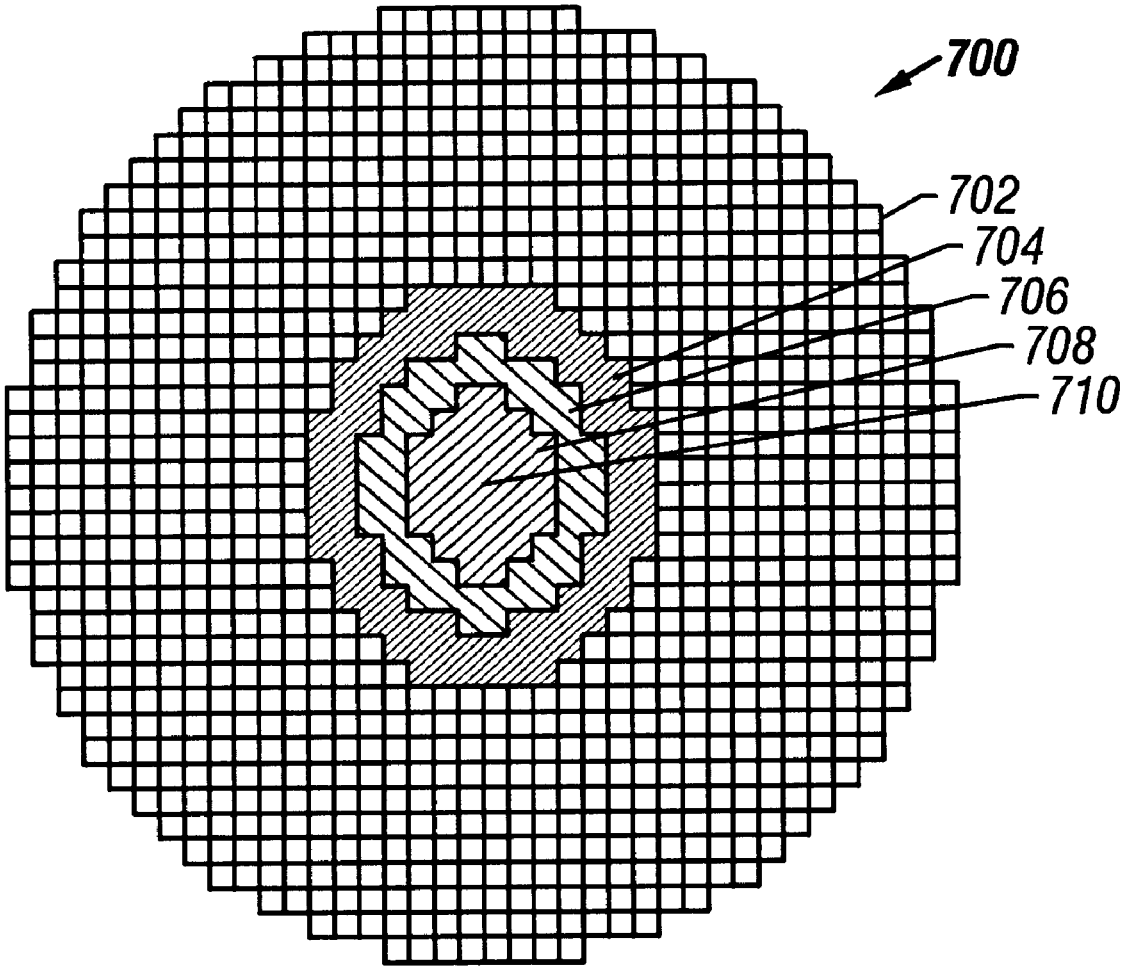
FIG. 7 is a diagram of a stepped beam taper for the aperture partitioning method of FIG. 5.

FIG. 7 is a diagram of a stepped beam taper 700 for one of the groups of the aperture partitioning method of FIG. 5. Shown in FIG. 7 are array elements radiating no power 702, array elements radiating a first step power level 704, array elements radiating a second step power level 706, array elements radiating a third step power level 708, and a taper center 710. The power levels are stepped or tapered with distance from the center of the group, so the center of the group is called the taper center 710.

The maximum array element power may be derived from the power radiated in each beam ($P_{BEAM\ i}$), where I is the beam index. The relative power between the steps of the taper is selected to meet the beam sidelobe requirements of the specific application. The relative power level for each taper step j, where j is the step index, may be defined as $$\alpha_{STEP\ j} = \frac{\text{power level of elements in step } j}{\text{maximum power level of any element used for this beam}} \tag{3}$$

The power radiated in each beam may be expressed as a sum of the power in each step of the taper:

$$P_{BEAM\ i} = \sum_{j=1}^{N_{STEPS}} P_{BEAM\ i,STEP\ j} \tag{4}$$

where $P_{BEAM\ i,\ STEP\ j}$ is the power in the jth step of the ith beam. The power in each step of the taper is the product of the power per unit area in the step and the area of the array elements that make up the step:

$$P_{BEAM\ i,\ STEP\ j} = W_{BEAM\ i,\ STEP\ j} A_{BEAM\ i,\ STEP\ j} \tag{5}$$

where $W_{BEAM\ i,\ STEP\ j}$ is the power per unit area or power density of the jth step of the ith beam and $A_{BEAM\ i,\ STEP\ j}$ is the total area of the array elements in the jth step of the ith beam. The power radiated in the ith beam is then given by $$P_{BEAM\ i} = \sum_{j=1}^{N_{STEPS}} W_{BEAM\ i,STEP\ j} A_{BEAM\ i,STEP\ j} \tag{6}$$

The power density in the jth step of the ith beam is given by $$W_{BEAM\ i,\ STEP\ j} = \alpha_{STEP\ j} W_{BEAM\ i,\ MAX} \tag{7}$$

where $\alpha_{STEP\ J}$ is the relative power level in the jth step given by (3) and $W_{BEAM\ i,\ MAX}$ is the maximum power density in the ith beam. The power in the ith beam may then be expressed as $$P_{BEAM\ i} = W_{BEAM\ i,\mathrm{MAX}} \sum_{j=1}^{N_{STEPS}} \alpha_{STEP\ j} A_{BEAM\ i,STEP\ j} \tag{8}$$

The maximum power density in the ith beam is then $$W_{BEAM\ i,\mathrm{MAX}} = \frac{P_{BEAM\ i}}{\sum_{j=1}^{N_{STEPS}} \alpha_{STEP\ j} A_{BEAM\ i,STEP\ j}} \tag{9}$$

The amount of power radiated into the ith beam by an array element in the jth step of the ith beam is given by $$\begin{aligned} P_{ELEMENT,BEAM\ i,STEP\ j} &= W_{BEAM\ i,STEP\ j} A_{ELEMENT} \\ &= \alpha_{STEP\ j} W_{BEAM\ i,\mathrm{MAX}} A_{ELEMENT} \end{aligned} \tag{10}$$

where $A_{ELEMENT}$ is the area of one array element.

The total power radiated by one array element is the sum of all the power that the array element radiates for every beam that uses that array element. In terms of the expression in (10), the total array element power is $$P_{ELEMENT,TOTAL} = \sum_{i=1}^{N_{BEAMS}} \sum_{j=1}^{N_{STEPS}} P_{ELEMENT,BEAM\ i,STEP\ j} \cdot \begin{cases} 1, & \text{if array element is in step } j \text{ of beam } i \\ 0, & \text{otherwise} \end{cases} \tag{11}$$

The maximum array element power is the maximum of the total power for all the array elements.

A cost function for minimizing the maximum array element power receives as input an array of taper center locations, evaluates the total array element power for each array element, and returns the maximum of the total power of all the array elements:

$$\text{cost function} = \max(P_{ELEMENT,\ TOTAL}|_{all\ elements}) \tag{12}$$

An optimization algorithm, such as "miOcin" from the Numerisk Institut described in "Non-Gradient Subroutines for Non-Linear Optimization", may be used with the cost function (12) to calculate the array of taper center locations for each array element group that minimizes the maximum array element power for all beams.

Figure 8:
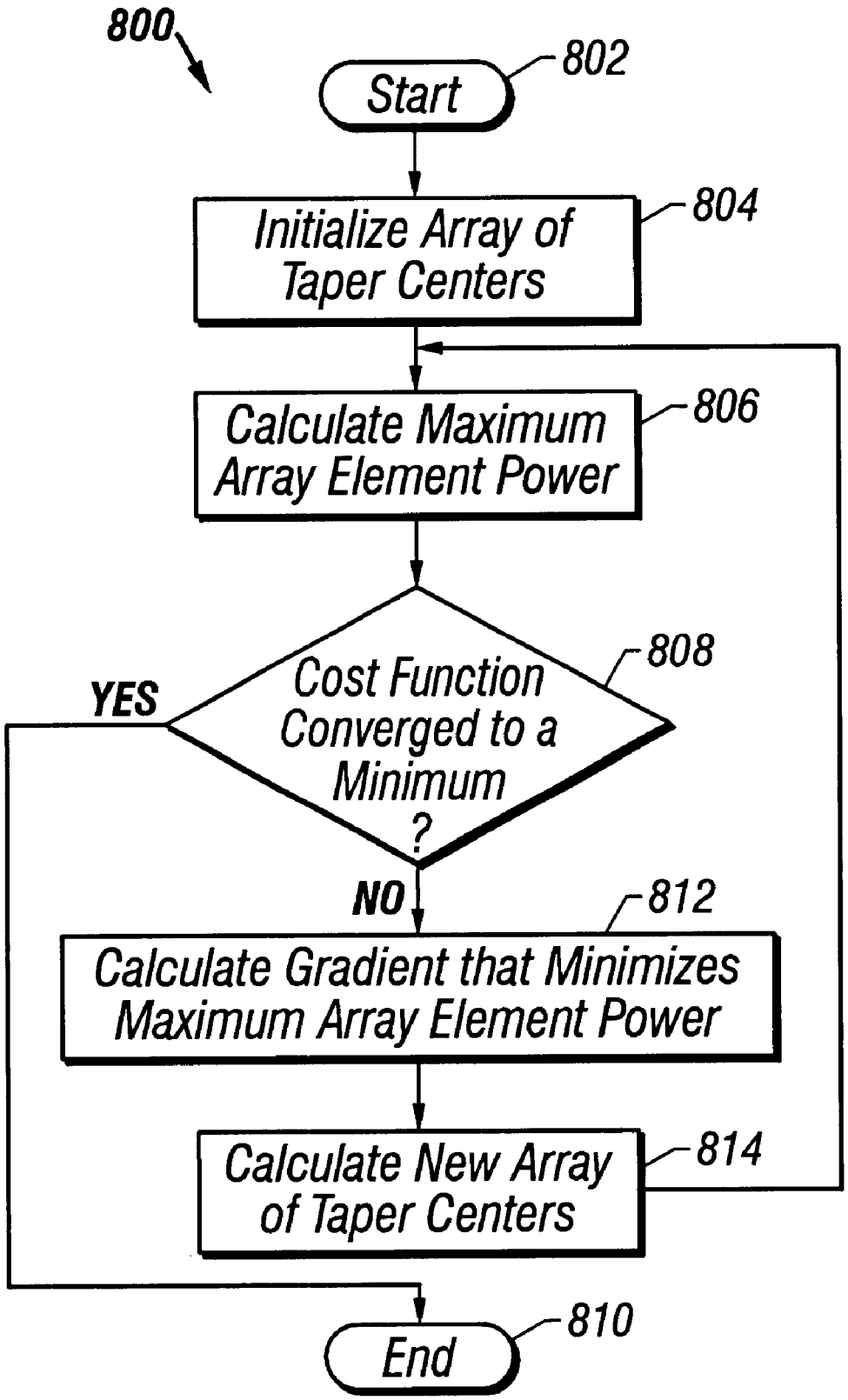
FIG. 8 is a flowchart of the aperture partitioning method of FIG. 5.

FIG. 8 is a flowchart 800 for the aperture partitioning method of FIG. 5. Step 802 is the entry point for the flowchart 800. Step 804 initializes the array of taper center locations. Step 806 calculates the maximum array element power from the cost function. Step 808 tests whether the cost function has converged to a minimum. If yes, the flowchart 800 exits at step 810. If no, Step 812 calculates the gradient that minimizes the maximum array element power. Step 814 calculates a new array of taper center locations from the gradient direction and transfers control to step 806.

Figure 9A:
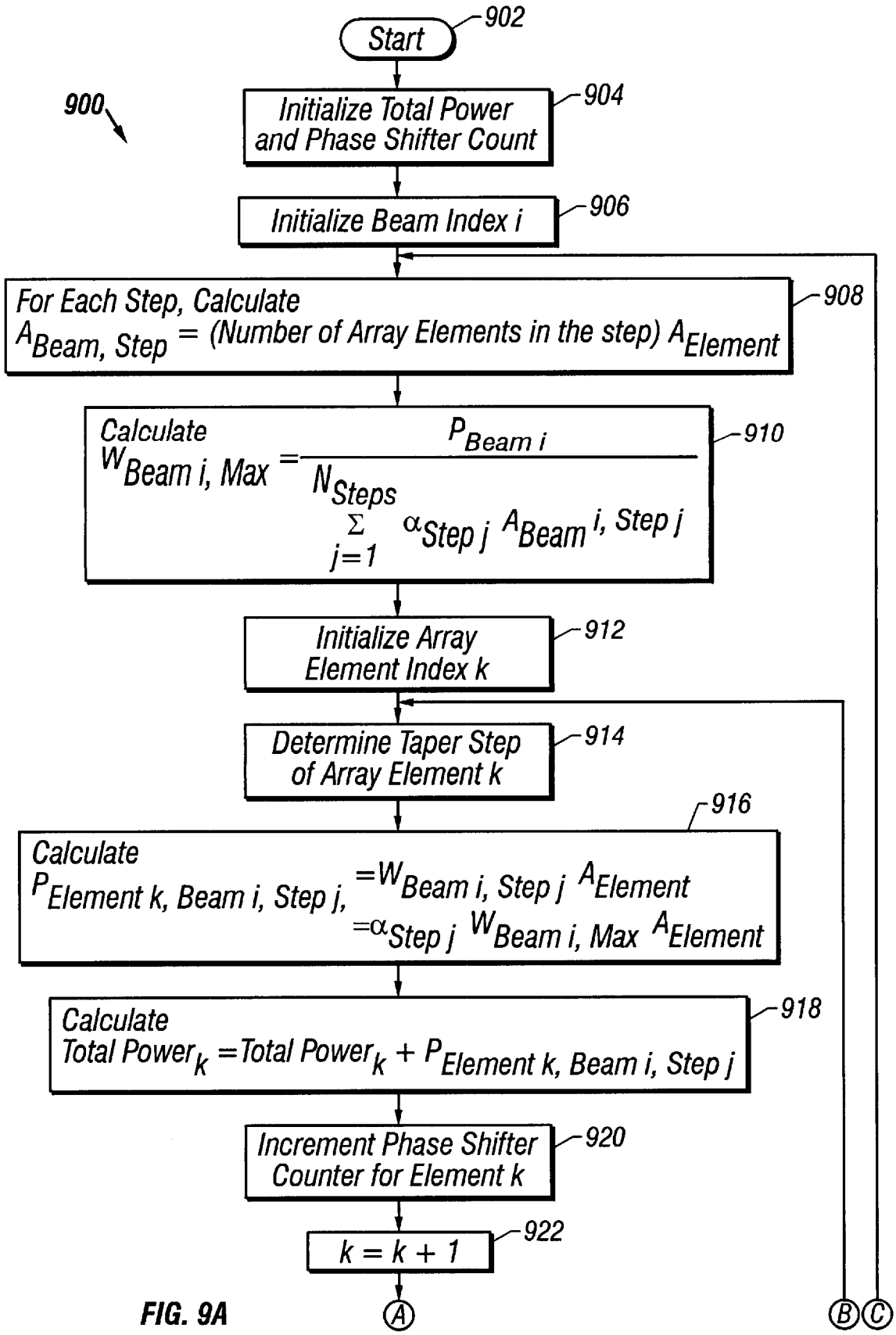
FIGS. 9A and 9B are a flowchart for calculating the total power to the array elements and the total number of phase shifters for the aperture partitioning method of FIG. 5.
Figure 9B:
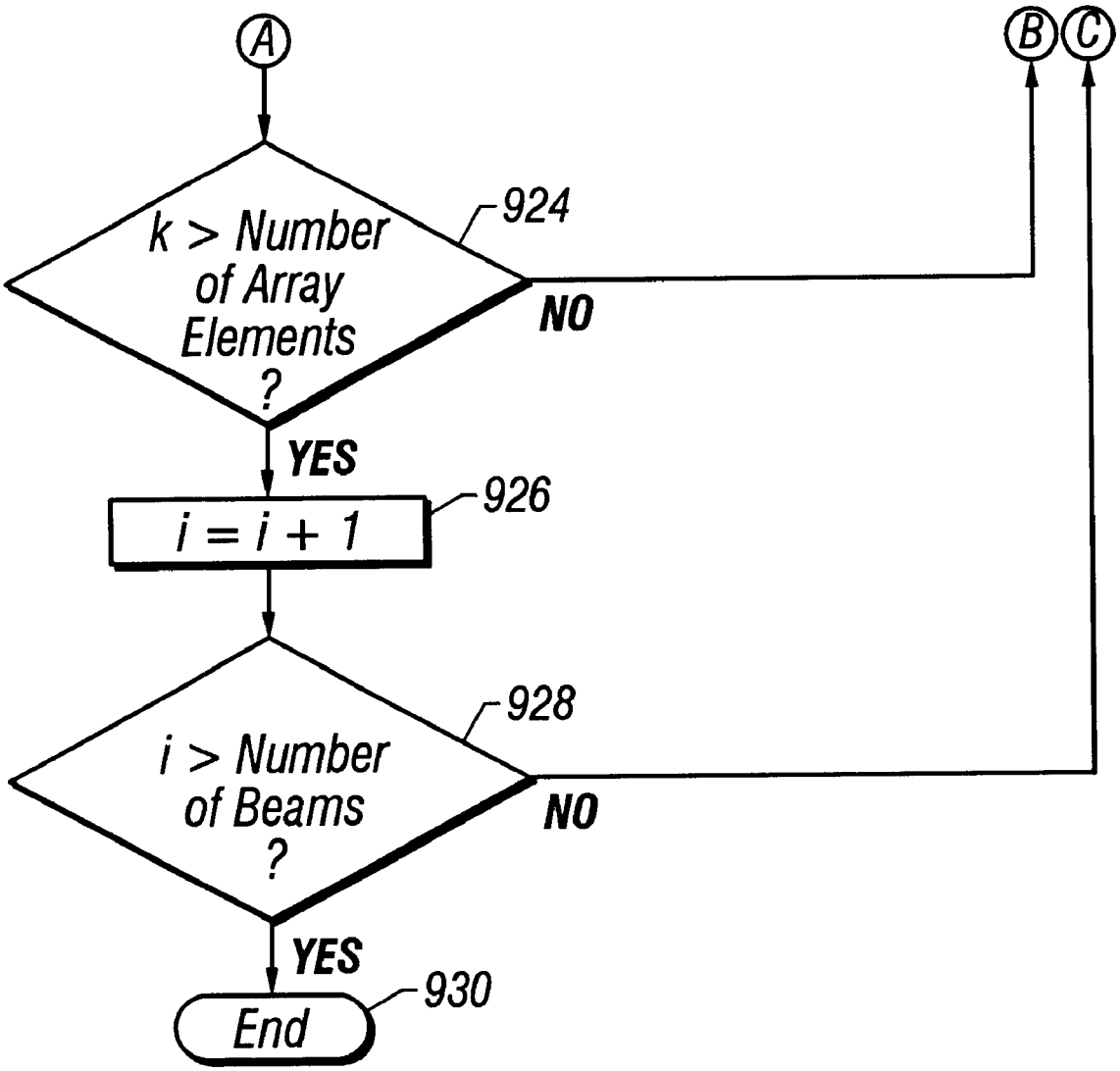

FIG. 9A and 9B are a flowchart 900 for calculating the total power to the array elements and the total number of phase shifters for the aperture partitioning method of FIG. 5. Step 902 is the entry point for the flowchart 900. Step 904 initializes the total power and phase shifter count to zero for every element k. Step 906 initializes the beam index i. Step 908 calculates the area of the array elements for each power level step according to $$A_{BEAM,\ STEP} = (\text{ number of array elements in the step }) \cdot A_{ELEMENT}$$

Step 910 calculates the beam power density $W_{BEAM,MAX}$ using (9). Step 912 initializes the array element index k. Step 914 determines which taper step array element k is in. Step 916 calculates array element power $P_{ELEMENT,BEAM,STEP}$ using (10). Step 918 adds the result from step 916 to the total power. Step 920 increments the phase shifter count by one for element k. Step 922 increments the array element index k by one. Step 924 checks whether k exceeds the number of array elements. If no, control is transferred to step 914. If yes, control is transferred to step 926. Step 926 increments the beam index i by one. Step 928 checks whether i exceeds the number of beams. If no, control is transferred to step 908. If yes, the flowchart 900 exits at step 930.

The maximum array element power and corresponding dynamic range requirements of the array element power amplifiers are reduced by almost an order of magnitude using the aperture partitioning described above compared to conventional array element grouping methods. The reduced dynamic range requirement for the array element power amplifiers results in lower cost. Another advantage is that the number of phase shifters and the complexity of the power combiner for the center array elements are substantially reduced.

While the invention herein disclosed has been described by means of specific embodiments and applications thereof, other modifications, variations, and arrangements of the present invention may be made in accordance with the above teachings other than as specifically described to practice the invention within the spirit and scope defined by the following claims.

What is claimed is:

1. A multiple beam phased array comprising a plurality of array elements partitioned into a plurality of array element groups for forming a plurality of beams wherein each array element group has a taper center located to minimize maximum array element power for the plurality of beams.

2. The multiple beam phased array of claim 1 wherein the location of the taper center of each partition is calculated by minimizing a cost function of the maximum array element power and a set of taper center locations.

3. A transponder platform comprising:

a multiple beam receiving antenna; and a multiple beam transmitting antenna coupled to the multiple beam receiving antenna comprising a plurality of array elements partitioned into a plurality of array element groups for forming a plurality of beams wherein each array element group has a taper center located to minimize maximum array element power for the plurality of beams.

4. The transponder platform of claim 3 wherein the location of the taper center of each array element group is calculated by minimizing a cost function of the maximum array element power and a set of taper center locations.

5. A method of partitioning a plurality of array elements for a multiple beam phased array comprising the steps of:

partitioning the plurality of array elements into a plurality of array element groups to form a plurality of beams; and locating a taper center of each array element group to minimize maximum array element power for the plurality of beams.

6. The method of claim 5 further comprising the step of calculating the location of the taper center of each array element group by minimizing a cost function of the maximum array element power and a set of taper center locations.

7. A multiple beam phased array comprising a plurality of array elements partitioned into a plurality of array element groups for forming a plurality of beams wherein each array element group has a taper center located at a point other than a center of the plurality of array elements.

8. A method of partitioning a plurality of array elements for a multiple beam phased array comprising the steps of:

partitioning the plurality of array elements into a plurality of array element groups to form a plurality of beams; and locating a taper center of each array element group at a point other than a center of the plurality of array elements.

* * * * *